United States Patent [19]

Antonov

[11] 4,278,838

[45] Jul. 14, 1981

[54] METHOD OF AND DEVICE FOR SYNTHESIS OF SPEECH FROM PRINTED TEXT

[75] Inventor: Lyubomir Y. Antonov, Sofia, Bulgaria

[73] Assignee: Edinen Centar Po Physika, Sofia, Bulgaria

[21] Appl. No.: 63,169

[22] Filed: Aug. 2, 1979

Related U.S. Application Data

[63] Continuation-in-part of Ser. No. 32,507, Apr. 23, 1979, abandoned, which is a continuation of Ser. No. 829,944, Sep. 1, 1977, abandoned.

[30] Foreign Application Priority Data

Sep. 8, 1976 [BG] Bulgaria ..... 34160

[51] Int. Cl.[3] ..... G10L 1/00

[52] U.S. Cl. ..... 179/1 SM; 179/1 SF

[58] Field of Search ..... 179/1 SM, 1 SG, 1 SF

[56] References Cited

U.S. PATENT DOCUMENTS 3,704,345 11/1972 Coker et al. ..... 179/1 SF 4,130,730 12/1978 Ostrowski ..... 179/1 SM

*Primary Examiner*—Mark E. Nusbaum

*Assistant Examiner*—E. S. Kemeny

*Attorney, Agent, or Firm*—Karl F. Ross

[57] ABSTRACT

Upon analyzing grammatically and phonetically a printed text for accents, pauses, intonations and influences of adjacent voice elements in a sentence to be synthesized, a computer loads a plurality of registers including an address counter with instructions for addressing a read-only memory, these instructions specifying rates of counting, numbers or counts, whether counting is to be decremental or incremental and initial addresses of sequences of binary bits coding successive magnitudes of noise signals or of voice-frequency functions. The output of the read-only memory is fed to a loudspeaker via a digital/analog converter and an amplifier whose output is modulated by a signal transmitted from the computer through another d/a converter. The durations of noise and voice-frequency speech elements read out from the memory and the modulation of their amplitudes by the amplifier are randomly modified within ±3% for the frequency and ±30% for the amplitude by the computer to obtain natural-sounding speech from the loudspeaker, while smooth transitions between phonemes or voice elements are attained via the insertion of noise or voice-frequency elements ensuring an even formant or frequency distribution.

4 Claims, 8 Drawing Figures

METHOD OF AND DEVICE FOR SYNTHESIS OF SPEECH FROM PRINTED TEXT

CROSS-REFERENCE TO RELATED APPLICATIONS

This application is a continuation-in-part of U.S. patent application Ser. No. 032,507 filed Apr. 23, 1979, (now abandoned) in turn a continuation of U.S. patent application Ser. No. 829,944 filed Sept. 1, 1977 and now abandoned.

FIELD OF THE INVENTION

My present invention relates to a method of and a device for synthesizing speech from a printed text.

BACKGROUND OF THE INVENTION

Methods for the synthesis of speech are known wherein different phonemes are obtained by combining sinusoidal oscillations of respective frequencies and respective amplitudes. Apparatuses implementing such methods are complex and require analog generators with complicated tuning.

Other devices are known which utilize large memories stored on magnetic disks. The vocabularies of such devices are nevertheless limited.

OBJECT OF THE INVENTION

The object of my present invention is to provide a method of and a device for the synthesis of speech which do not require analog-signal generators or an exorbitant amount of memory space.

SUMMARY OF THE INVENTION

A method for synthesizing speech comprises according to my present invention the steps of analyzing a printed text grammatically and phonetically for sequences of phonemes, for the placement of accents or stresses, for the placement and duration of pauses and intonations to form frequency and amplitude magnitude characteristics of a sentence to be synthesized. Binary signals coding at least in part successive magnitudes of voice-frequency functions are then read out from a read-only memory according to the frequency characteristics, the binary signals being converted at the output of the read-only memory into an analog signal. The analog signal is modulated according to the amplitude magnitude characteristics, the resulting signal being fed to a loudspeaker.

According to another feature of my present invention, quasirandom changes are introduced into the frequency and amplitude magnitude characteristics to facilitate the production of natural-sounding speech. The quasirandom variations are within ±3% for the frequency and ±30% for the amplitude.

According to a further feature of my present invention, the step of analyzing a printed text includes the formation of frequency and amplitude magnitude characteristics in accordance with reciprocal influences between adjacent phonemes.

According to yet another feature of my present invention, the read-only memory stores in binary code noise signals and voice-frequency functions.

A speech synthesizer implementing the above-described method comprises, according to my present invention, a computer for analyzing a printed text for sequences of phonemes, the placement of accents, the placement and duration of pauses and intonations to form frequency and amplitude magnitude characteristics of a sentence to be synthesized. A read-only memory storing binary signals coding at least in part successive amplitudes of voice-frequency functions is connected at an input to an address counter connected in turn to the computer for receiving therefrom according to the formed frequency characteristics initial addresses, rates of counting and numbers of counts. A digital-analog converter is tied to an output of the read-only memory for converting into an analog signal binary signals read from the memory by the counter. The computer and the digital-analog converter feed an amplifier for modulating the analog signal according to the amplitude magnitude characteristics; a loudspeaker at the output of the amplifier transduces modulated signals from the amplifier into acoustic energy.

BRIEF DESCRIPTION OF THE DRAWING

These and other features of my present invention will now be described in detail, reference being made to the accompanying drawing in which.

SPECIFIC DESCRIPTION

Figure 1:
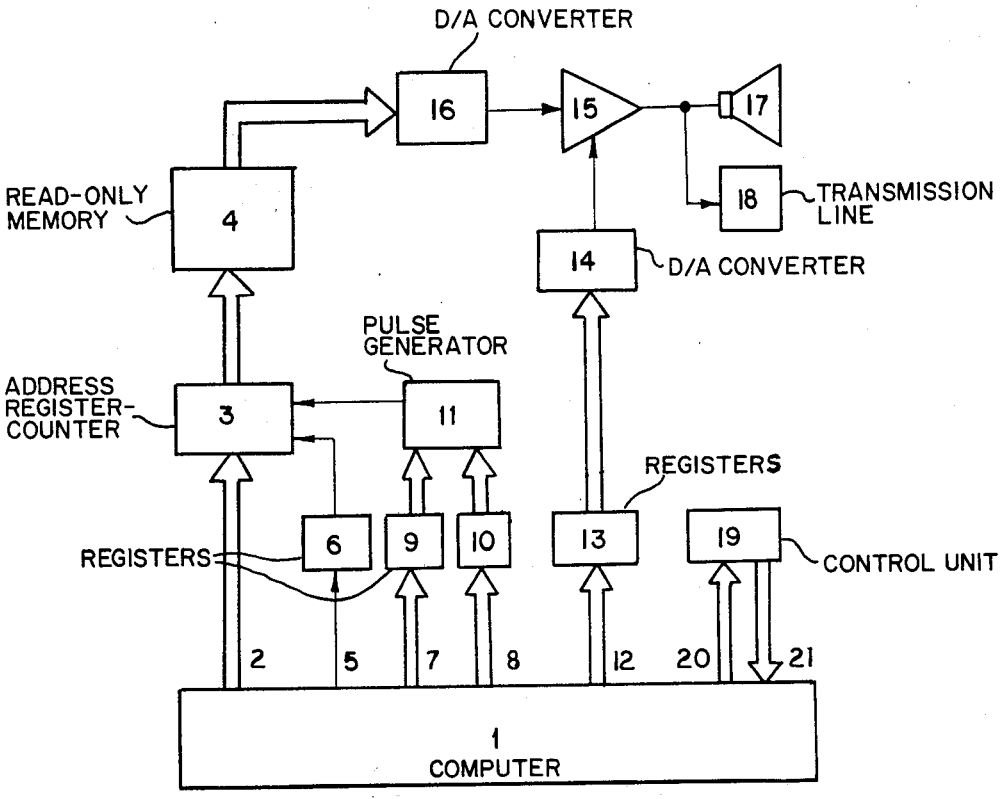
FIG. 1 is a block diagram of a speech synthesizer according to my present invention.

As illustrated in FIG. 1, a system for synthesizing speech from printed material comprises, according to my present invention, a read-only memory 4 storing digitally encoded magnitudes of voice-frequency signals which are read out to a digital-analog converter 16 by an address counter 3 under the control of a computer unit 1 which grammatically and phonetically analyzes a printed text for the placement and duration of accents and pauses and for the reciprocal influences of adjacent phonemes. Via a multiple 2 computer 1 feeds to counter 3 initial addresses of magnitude sequences coding formant distributions of respective voice phonemes, the direction of counting in unit 3 being determined by computer 1 via an output lead 5 and a register 6. The counter is stepped by a pulse generator 11 which receives from computer 1 over a lead 7 and a register 9 information regarding the rate at which pulses are to be transmitted to counter 3. Computer 1 generates substantially simultaneously on leads 2, 5, 7 signals coding an initial address, a direction of counting, i.e. incremental or decremental, and a frequency of counting, respectively, and on a lead 8 a signal coding a number of counts to be made successively incrementing or decrementing the initial address carried by multiple 2. Lead 8 extends to a register 10 in turn feeding pulse generator 11.

Digital-analog converter 16 works into an amplifier-modulator 15 tied at an output to a loudspeaker 17 and to a transmission line 18 and having a gain which varies in response to an analog signal from another digital-analog converter 14, this converter receiving digital signals from computer 1 over a lead 12 and a register 13. A control circuit 19 (see FIG. 2) has input and output leads 20, 21 extending to computer 1.

Figure 2:
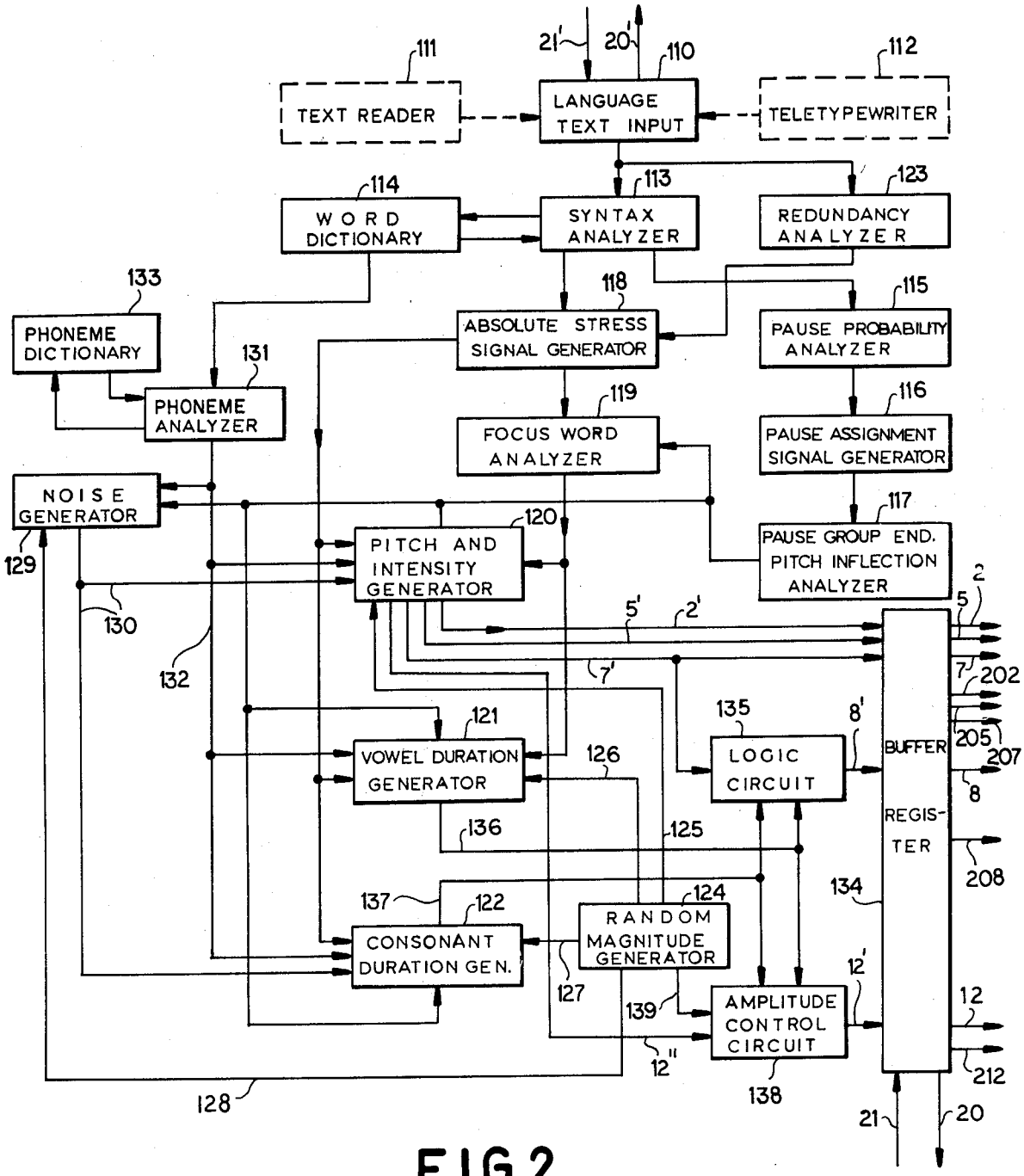
FIG. 2 is a block diagram of a computer unit shown in FIG. 1.

As illustrated in FIG. 2, computer 1 includes a syntax analyzer 113 receiving from a language-text input 110 electronic signals encoding sentences taken from printed material by a text reader 111 or fed to input 110 by a teletypewriter 112, language text input 110 also feeding a redundancy analyzer 123. Analyzers 113 and 123 have respective output leads working into an absolute-stress signal generator 118, while syntax analyzer 113 has an additional output lead extending to a pause-probability analyzer 115 which is tied in cascade to a pause-assignment signal generator 116 and to an analyzer 117 for determining pitch inflection in a syllable immediately preceding a pause assigned by generator 116. Analyzer 117, together with signal generator 118, transmits output signals to a focus-word analyzer 119, to a pitch and intensity signal generator 120, to a vowel-duration generator 121, and to a consonant-duration generator 122, analyzer 119 feeding generators 120 and 121. A random-magnitude generator 124 has output leads 125, 126, 127 extending to generators 120, 121 and 122, respectively, and a further output lead 128 working into a noise generator 129 (p. 441, *IEEE Standard Dictionary of Electrical Electronics Terms*, Second Edition) in turn tied to units 120 and 122 via a lead 130.

A phoneme analyzer 131 receiving input signals from a word dictionary 114 under the control of syntax analyzer 113 emits output signals to generators 120, 121, 122, 129 via a lead 132, analyzer 131 being connected to a phoneme dictionary 133 (see pp. 466 and 467 of *Speech Synthesis*, Dowden Stroudsburg, Pa., 1973) for determining with the aid thereof the modification of a phoneme's formant distribution according to the effects of adjacent phonemes and for inserting an additional phoneme between consecutive phonemes to ensure an even formant transition.

Pitch and intensity generator 120 has output leads 2', 5', 7' extending to a buffer register 134 (Chapter 8, page 15 and Chapter 11, pages 45, 46 of *Handbook of Telemetry and Remote Control*, McGraw-Hill Book Co., New York, 1967) where they are connected to leads 2, 5, 7, respectively, under the control of signals carried by lead 21 from unit 19 (FIG. 1). Thus, leads 2',5', 7' transmit signals encoding initial addresses in memory 4 (FIG. 1), direction of counting in unit 3, and rate of pulse emission by generator 11. Lead 7' is also tied to a logic circuit 135 which has two further input leads 136, 137 extending from vowel-duration and consonant duration generators 121 and 122, respectively. On an output lead 8' logic circuit 135 emits signals encoding the number of pulses to be supplied to counter 3 by generator 11 for respective initial addresses carried by lead 2. Lead 8' extends to buffer register 134 and is connected to lead 8 under the control of circuit 19. Output leads 136, 137 of generators 121, 122 are also connected to an amplitude control circuit 138 (U.S. Pat. No. 3,704,345) which emits on a lead 12' digital signals determining the gain of amplifier 15 (FIG. 1) and consequently the loudness of voice-phoneme sound waves produced by transducer or loudspeaker 17. Lead 12' works into buffer register 134, and signal carried by lead 12' being subsequently transmitted onto lead 12 under the control of circuit 19. Amplitude control unit 138 has further input leads 12'' and 139 extending from pitch and intensity generator 120 and from random-magnitude generator 124, respectively.

The operation of syntax analyzer 113 to determine the grammatical structure of a sentence translated into electronic signals by text input 110, the operation of analyzer 115 and generator 116 to determine the location and duration of pauses in a sentence grammatically and syntactically analyzed by unit 113, and the operation of generator 118 and analyzer 119 to determine word stress or accent have been described in U.S. Pat. No. 3,704,345. In response to signals from analyzer 113 dictionary 114 transmits to analyzer 131 phoneme data for each sentence analyzed by unit 113. This data specifies for each word a unique sequence of elemental phonemes each having a characteristic or standard formant distribution and a respective duration. An elemental phoneme's distribution is subsequently modified by analyzer 131 in accordance with information stored in dictionary 133 regarding the reciprocal effects of adjacent phonemes. Thus, depending on the particular phonemes to which a given phoneme is adjacent, the various components of this phoneme may be changed in frequency or new frequencies may be added, the modified formant distributions of the consecutive phonemes being fed to pitch and intensity analyzer 120. In addition, the duration of a phoneme read out from dictionary 114 may be increased or decreased by analyzer 131 depending on the identities of adjacent phonemes, the modified durations of respective phonemes being transmitted to vowel-duration and consonant-duration generators 121, 122 in parallel with the pitch and intensity data emitted to generator 120. Analyzer 131 may also be adapted to modify the frequency and amplitude characteristics and the durations of phonemes in accordance with position in a word. Thus, phonemes in unaccented syllables may be slightly shortened, while phonemes at the end of a word or in an accented syllable may be lengthened.

Upon analyzing a sequence of phonemes received from dictionary 114, unit 131 may insert additional voice-frequency phonemes to ensure even formant transitions between consecutive phonemes specified by dictionary 114. Further alterations of pitch and intensity are made by generator 120 in response to signals from pitch-inflection analyzer 117, absolute-stress generator 118 and focus-word analyzer 119, as described in U.S. Pat. No. 3,704,345. In the English language, certain phonemes, particularly some consonants, are characterized by relatively noisy sounds as opposed to discrete formant distributions. In a synthesizer according to my present invention such portions or phonemes are identified by generator 129 with spectrally discrete phonemes identified by analyzer 131. Generator 129 selects a noise phoneme from among a plurality of predetermined phonemes in accordance with data emitted by analyzer 131; the selected noise sound is inserted into a voice phoneme by generator 120 at a time determined by unit 129 at least partially in response to signals received from random-magnitude generator 124.

The signal transmitted to generator 130 over lead 120 specifies a cluster of consecutive addresses in read-only memory 4 of successive magnitudes of acoustic noise signals. An initial or starting address in the cluster specified by generator 129 is selected by generator 120 at least partially in response to quasi-random signals emitted by generator 124, this initial address being generated on lead 2'. In addition, for a noise phoneme identified by unit 129, a rate of counting in unit 3 (FIG. 1) is quasi-randomly selected by generator 120, i.e. selected within predetermined limits according to a signal carried by lead 125, and this rate of counting is encoded in a signal emitted on lead 7'. For noise phonemes, lead 5' is randomly energized.

Among the pauses assigned by units 115 and 116 generator 129 selects intervals for the insertion of noise phonemes approximating sounds normally accompanying speech, e.g. inhalation sounds. The duration of such noise phonemes together with the pitch and intensity thereof may be modified by generators 122 and 120 at least partially in accordance with information from analyzer 117 indicating the overall rate of speech.

The relative stress on syllables within respective words and the relative stress on words within respective phrases, in short the loudness of various elements of speech produced at the output of transducer 17, are controlled by circuit 138 in response to signals carried by leads 12", 136, 137. In order to ensure a smooth transition between consecutive voice and nose phonemes, circuit 138 automatically reduces to zero the gain of amplifier 15 during the phoneme transitions. Thus, spikes arising from abrupt transitions are substantially reduced in number. Because the gain of amplifier-modulator 15 is zero during a phoneme transition interval lasting only several cycles while the duration of a phoneme is generally of the order of a hundred cycles (see U.S. Pat. No. 3,704,345) the reductions in amplitude of the acoustic wave produced by transducer 17 are largely undetectable by the human ear.

Upon the grammatical and syntactical analysis of a sentence by analyzer 113, the determination of stress and accent placement by signal generator 118 and analyzer 119, the determination of the placement and duration of pauses and pitch intonation by units 115, 116, 117, and the modification of phoneme sequences by analyzer 131 according to the reciprocal effects of adjacent phonemes, generator 120 emits on leads 2', 5', 7' digital signals encoding the frequency, i.e. pitch, characteristics of the analyzed sentence. These pitch characteristics comprise a sequence of voice phonemes and noice phonemes. In the case of voice phonemes, an initial address emitted on lead 2' identifies a cluster of binary signals stored in memory 4 and coding at least in part successive magnitudes of a voice-frequency function, the frequency or rate at which these binary signals are read from memory 4 being determined by a signal carried by lead 7'. Thus, each voice-phoneme address emitted by generator 120 is associated with a family of voice phonemes having different absolute pitches and formant distributions with the same ratios of component frequencies.

The signal carried by lead 7' is fed to logic circuit 135 which includes a multiplier for forming a product between the rate of counting generated by unit 120 and a duration generated by unit 121 or 122, this product constituting a number of stepping pulses to be emitted by generator 11 (FIG. 1) to counter 3. In the case of noise phonemes, specified by generator 129 for the production of sounds accompanying speech, e.g. breathing sounds, or for the production of mixed phonemes, initial addresses, directions of counting and rates of counting emitted by generator 120 on leads 2', 5', 7' are randomly selected by unit 120 within predetermined limits and partially in response to signals received from generator 124.

Together with frequency characteristics on leads 2, 5', 7', generator 120 emits on lead 12" digital signals encoding amplitude characteristics of an analyzed sentence, these characteristics determining the loudness of each phoneme synthesized by the device illustrated in FIG. 1. In response to the signals carried by leads 12", 136, 137 circuit 138 generates on lead 12' a sequence of pulses whose rate of recurrence is proportional to the loudness of respective phonemes identified by signals on leads 2', 5', 7'. This sequence of pulses is subsequently converted to an analog signal by unit 14 (FIG. 1).

To facilitate the production of natural-sounding speech, a synthesizer according to my present invention varies the pitches ±3% and amplitude magnitudes of respective phonemes within ±30% limits. Thus, generator 120 increases or decreases rates of counting transmitted on lead 7' by amounts determined by signals from random magnitude generator 124 over lead 125. The times at which variations are induced are also determined by signals generated by unit 124. The amplitude magnitudes of the synthesized phonemes are varied by amplitude control circuits in response to signals emitted by unit 124 on lead 139. In addition, phoneme durations are shortened or lengthened by generators 121 and 122 up to 3% limits according to data received from generator 124 on leads 126 and 127. Deviations may be selected by generator 124 according to a normal probability distribution, as is well known in the art.

As shown in FIG. 2 digital signals fed to buffer register 134 may be emitted on leads 2, 5, 7, 8, 12 under the control of circuit 19 (FIG. 1). Owing to the high speed operation of present-day integrated circuitry, a computer such as heretofore described with respect to FIG. 2 may analyze sentences interleaved from two or more sources, i.e. two or more read-only memories 4 may be addressed by the same computer 1 for the simultaneous synthesis of a plurality of different speeches. Thus, buffer register 134 may include a multiplexer (not shown) for alternately connecting leads 2', 5', 7', 8', 12' to leads 2, 5, 7, 8, 12 extending to a first read-only memory 4 or to leads 202, 205, 207, 208, 212 extending to a second memory 4. The multiplexer switching is controlled by circuit 19 via signals generated on lead 21, while the feeding of sentences from respective textual materials to the syntax analyzer 113 is controlled by circuit 19 via signals emitted on a lead 21' (FIG. 2). Control circuit 19 receives input information including the presence of signals in registers of unit 134 via leads 20 and 20'.

Figure 3:
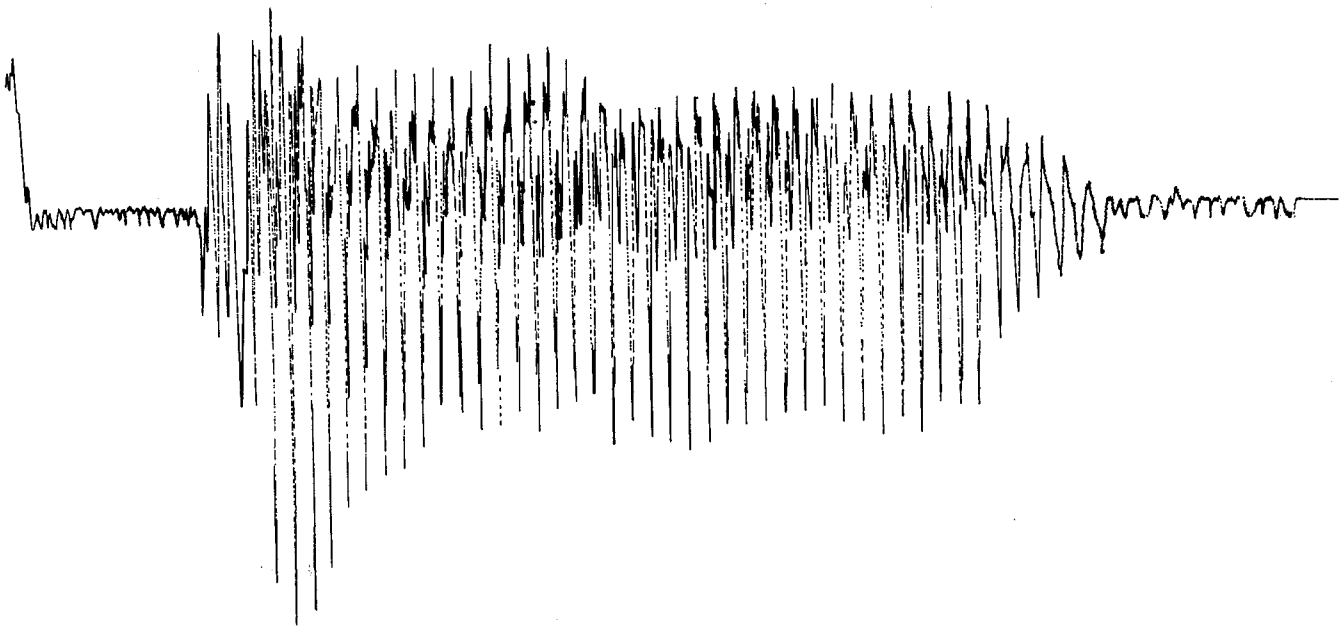
FIG. 3 is a graph of sound oscillations or pressure variations produced by a person upon speaking the Cyrillic word " πHA"
Figure 4:
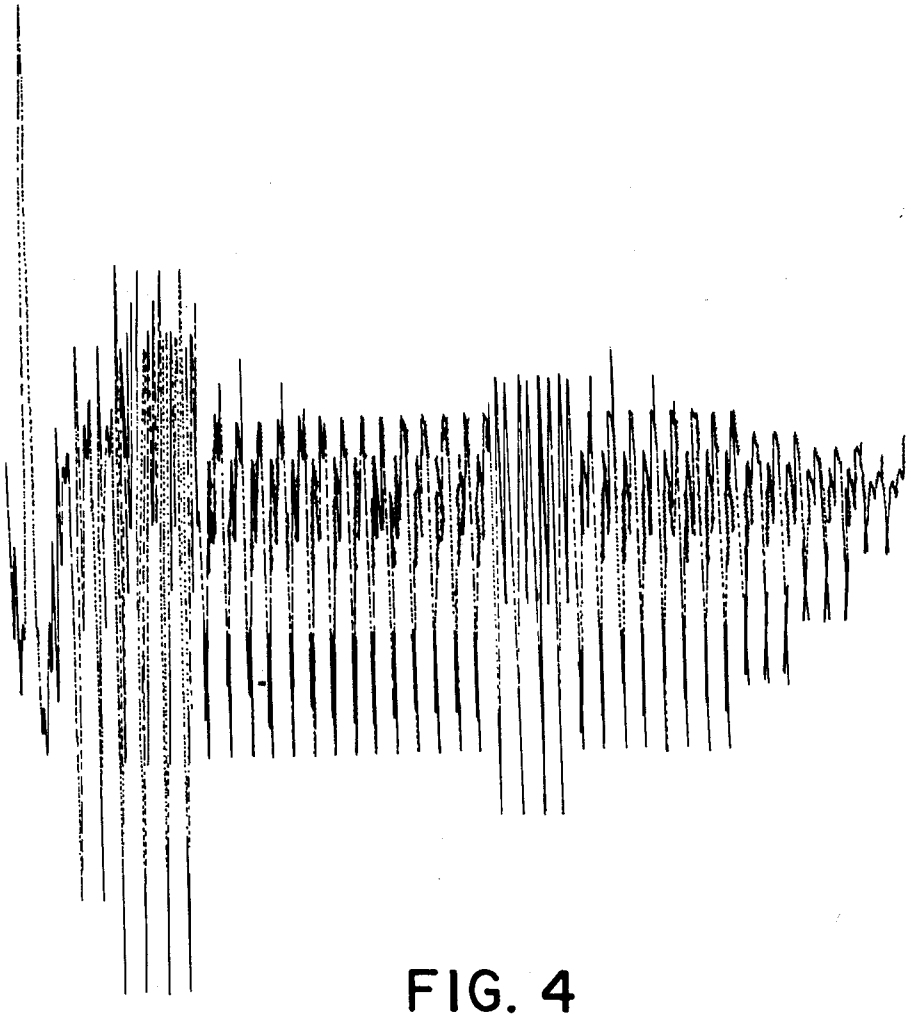
FIG. 4 is a graph of pressure variations produced by the device shown in FIG. 1, corresponding to the word " πHA"

FIG. 3 shows a short burst or occurrence of a Cyrillic "Т" followed by several periods of a Cyrillic "Я". Thereafter follow two groups of acoustic cycles corresponding to the Cyrillic phonemes "H" and "A". The loudness graph of FIG. 3 is derived from a word spoken by a human being, whereas the graph shown in FIG. 4 is of a word "ТЯH A" synthesized by a device according to my present invention. FIG. 4 shows in a sequence sound oscillations corresponding to the Cyrillic phonemes "т", "N", "E", "A", "H" and "A". A comparison of the sound graphs shown in FIGS. 3 and 4 clearly reveals the effectiveness of analyzer 131.

Figure 5:
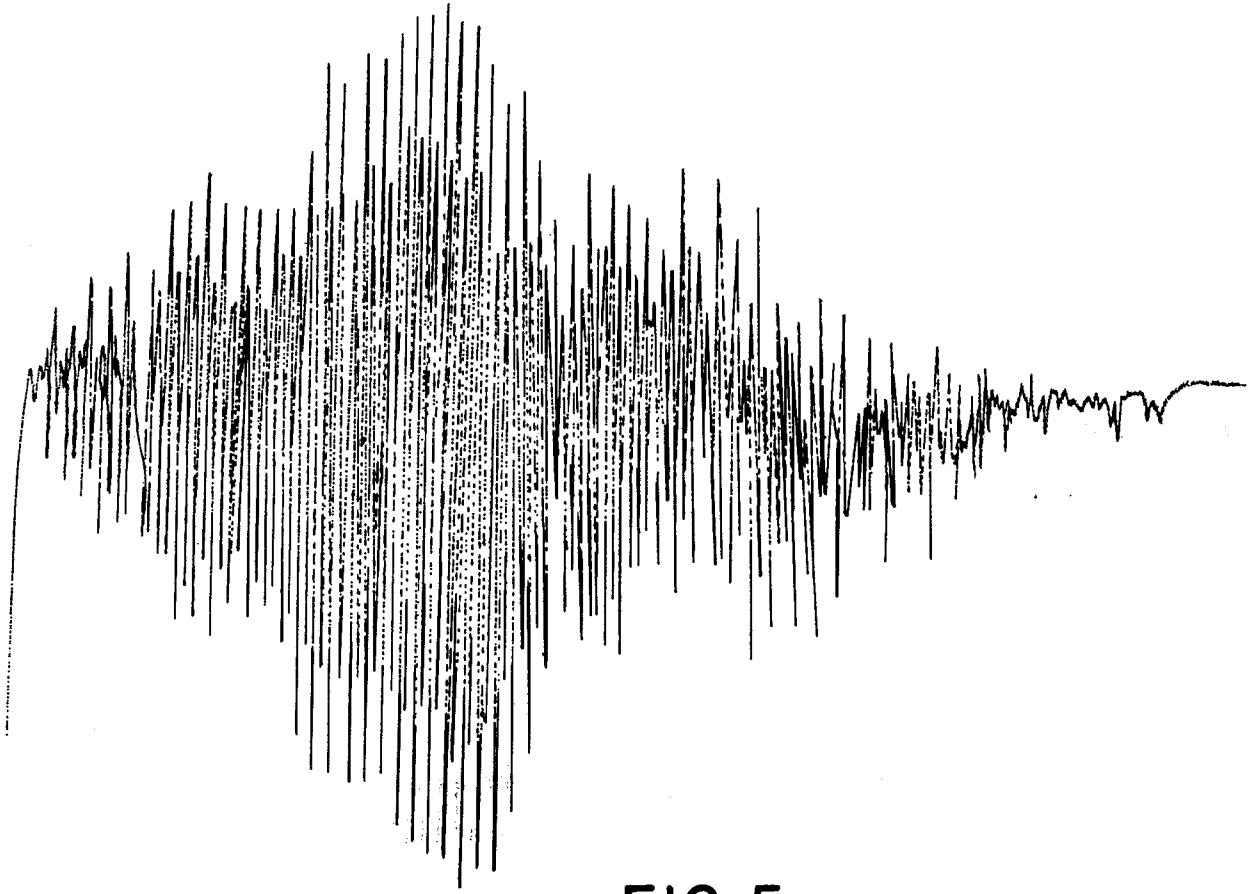
FIG. 5 is a graph of pressure variations of another word spoken by a human being.
Figure 6:
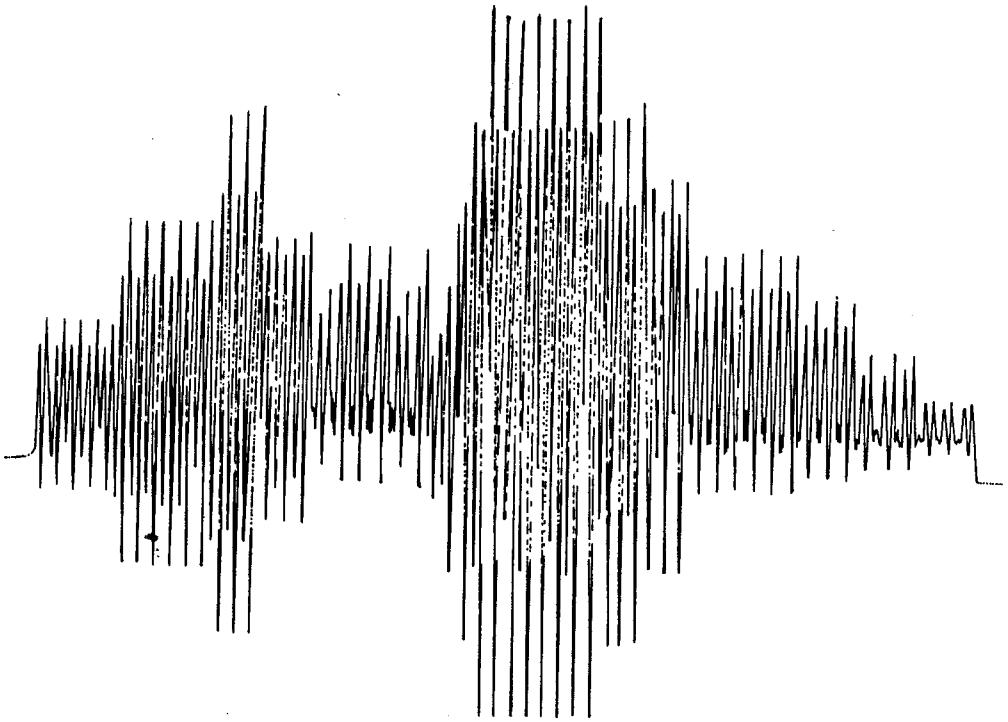
FIG. 6 is a graph of pressure variations of a word synthesized by the device shown in FIG. 1, corresponding to the word whose graph is shown in FIG. 5.
Figure 7:
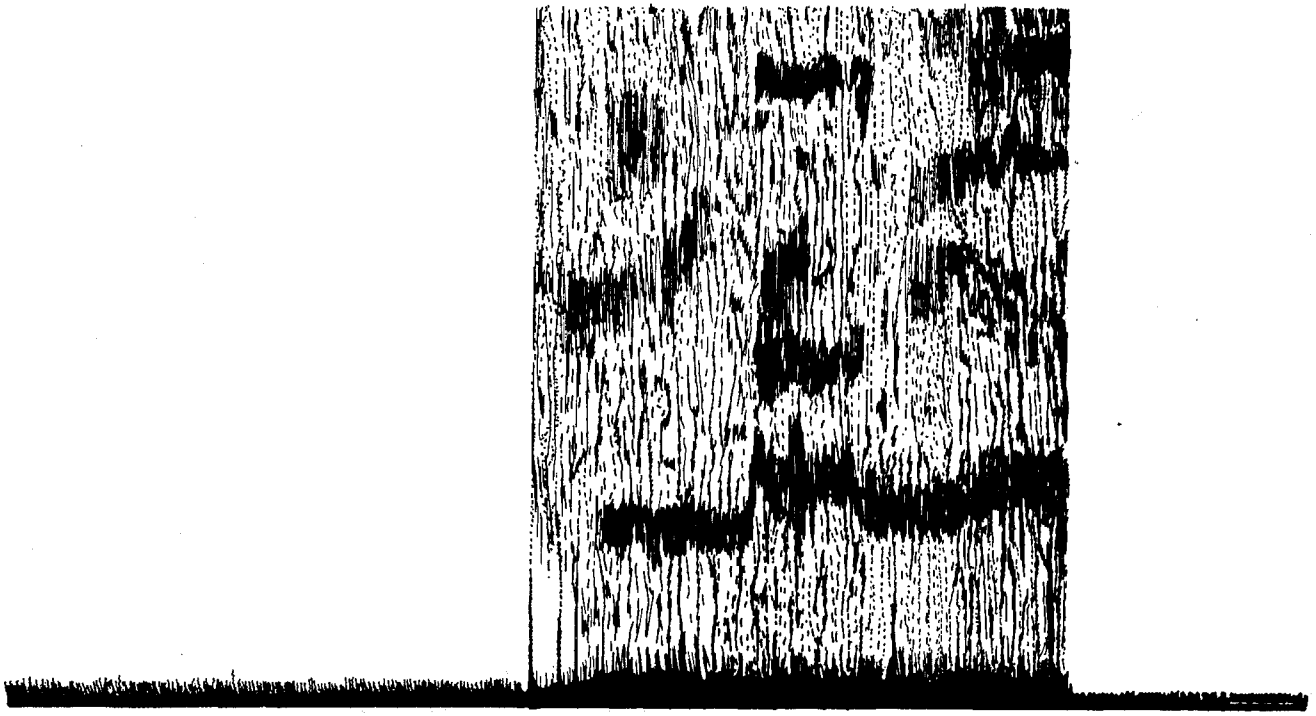
FIG. 7 is a sound spectrogram of the spoken word whose graph is shown in FIG. 5.
Figure 8:
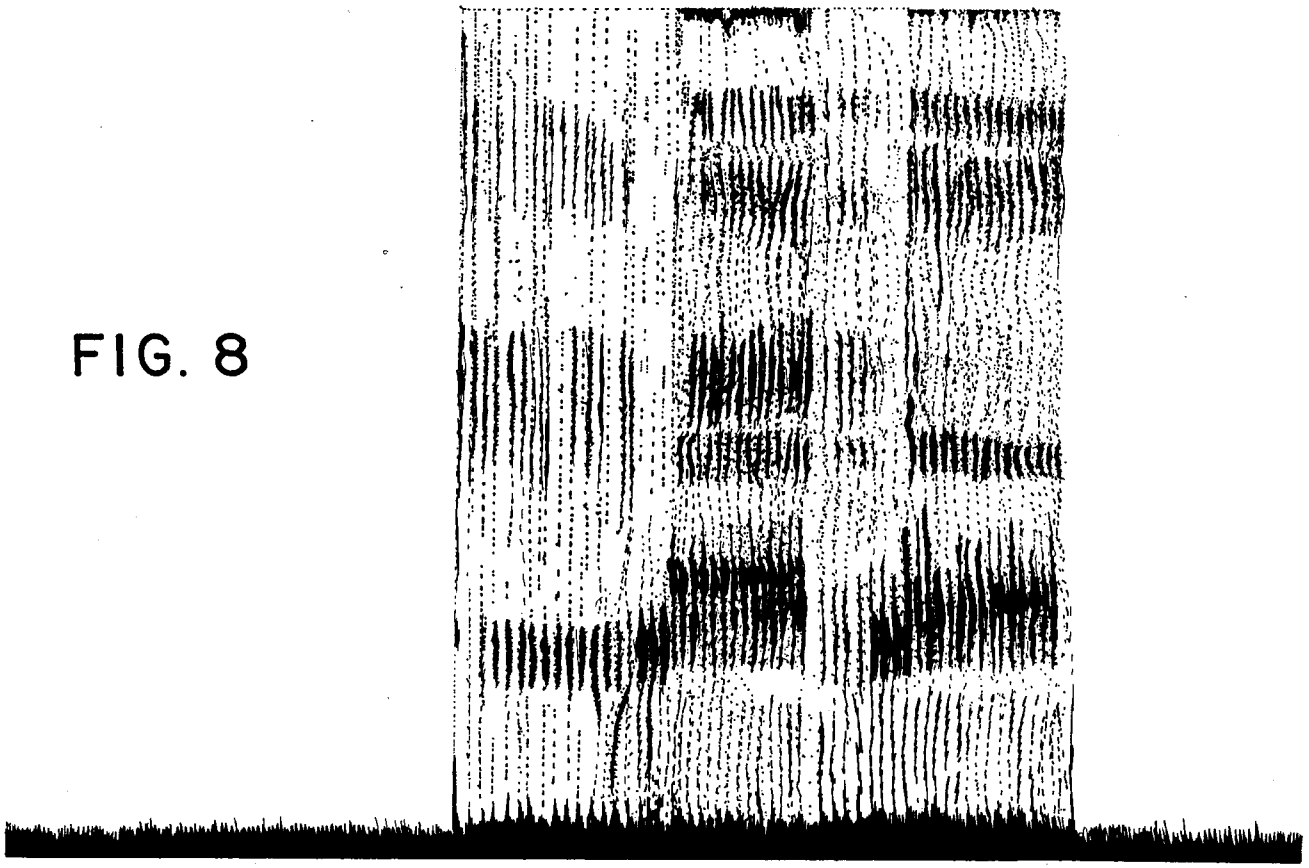
FIG. 8 is a sound spectrogram of the synthesized word whose graph is shown in FIG. 6.

The correlation between graphs shown in FIGS. 5 and 6 for a word spoken by a human being and synthesized by a device according to my invention, respectively, is analogous to the correlation between the graphs illustrated in FIGS. 3 and 4. A phoneme "ü" is introduced between a first "M" and the following "I" to obtain a smooth formant transition. FIGS. 7 and 8 are sound spectrograms of the words whose amplitude or loudness graphs are shown in FIGS. 5 and 6. The spectrogram of the spoken word is richer in formants than the synthesized word, but the synthesized word is nevertheless easily recognized by the ear.

An advantage of a synthesizer according to my present invention is that it requires no analog-signal generators which require a complicated tuning. In addition, The synthesizer shown in FIG. 1. provides for changes in the phonemes generated merely by changing the contents of the read-only memory. Natural-sounding speech is closely approximated through the use of phoneme analyzer 131 and random-magnitude generator 124 (FIG. 2). Memory space is conserved owing to the utilization of analyzer 131 and noise generator 129. The successive magnitudes of voice-frequency signals stored in binary form in memory 4 are predetermined according to an analysis of spoken words or may be generated electronically.

I claim:

1. A method for synthesizing speech, comprising the steps of:

analyzing a printed text grammatically and phonetically for sequences of phonemes, for the placement of accents, for the placement and duration of pauses and intonations to form frequency magnitude and amplitude characteristics of a sentence to be synthesized;

reading out from a read-only memory, according to said frequency magnitude characteristics, binary signals coding at least in part successive magnitudes of voice-frequency functions;

converting said binary signals at the output of said read-only memory into an analog signal;

modulating said analog signal according to said amplitude characteristics;

introducing quasirandom changes in said frequency magnitude and amplitude characteristics to facilitate the production of natural-sounding speech, the quasirandom changes introduced in said frequency magnitude and amplitude characteristics being within the limits of ±3% for the frequency and ±30% for the amplitude; and feeding the modulated analog signal to the loudspeaker.

2. A method as defined in claim 1 wherein the step of analyzing a printed text includes the step of modifying said frequency magnitude and amplitude characteristics in accordance with reciprocal influences between adjacent phonemes in a sentence to be synthesized.

3. A method as defined in claim 1 wherein said read-only memory stores in binary code noise signals along with voice-frequency functions.

4. A speech synthesizer comprising:

a computer for analyzing a printed text for sequences of phonemes, the placement of accents, the placement and duration of pauses and intonations fc form frequency and amplitude characteristics of a sentence to be synthesized;

means for introducing into the analysis quasirandom changes in said frequency characteristics ±3% and in said amplitude characteristics of ±30%;

a read-only memory storing binary signals coding at least in part successive amplitudes of voice-frequency functions;

counting means coupled with an input of said read-only memory for addressing same, said counting means being connected to said computer for receiving therefrom according to said frequency characteritics initial addresses, rates of counting, and numbers of counts;

a digital/analog converter connected to an output of said read-only memory for converting into an analog signal binary signals read from said read-only memory by said counting means;

an amplifier having an input extending from said computer and another input extending from said digital/analog converter for modulating said analog signal according to said amplitude characteristics; and a loudspeaker connected to an output of said amplifier for transducing into acoustic energy the modulated signal from said amplifier.

* * * * *